US008245347B2

(12) United States Patent
Goldberg et al.

(10) Patent No.: US 8,245,347 B2
(45) Date of Patent: Aug. 21, 2012

(54) CLEANING APPARATUS FOR A COMPONENT OF A HOUSEHOLD TUMBLE DRYER

(75) Inventors: Roman Goldberg, Dresden (DE); Klaus Grunert, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 962 days.

(21) Appl. No.: 12/223,998

(22) PCT Filed: Jan. 9, 2007

(86) PCT No.: PCT/EP2007/050162

§ 371 (c)(1),
(2), (4) Date: Aug. 13, 2008

(87) PCT Pub. No.: WO2007/093461

PCT Pub. Date: Aug. 23, 2007

(65) Prior Publication Data

US 2010/0319146 A1 Dec. 23, 2010

(30) Foreign Application Priority Data

Feb. 17, 2006 (DE) ..... 10 2006 007 443

(51) Int. Cl.
*A47L 15/00* (2006.01)

(52) U.S. Cl. ..... 15/88.4; 15/302

(58) Field of Classification Search ..... 15/21.1, 15/88, 88.4, 302; *A47L 15/00*
See application file for complete search history.

(56) References Cited

U.S. PATENT DOCUMENTS

| | | | | | |
|---|---|---|---|---|---|
| 1,985,156 | A | * | 12/1934 | Fieldhouse | 165/84 |
| 3,214,867 | A | * | 11/1965 | Henning | 451/76 |
| 4,660,627 | A | * | 4/1987 | Deck | 165/86 |
| 4,766,452 | A | * | 8/1988 | Ohara et al. | 396/411 |
| 5,013,368 | A | * | 5/1991 | Maroy et al. | 134/22.11 |
| 5,211,028 | A | * | 5/1993 | Remo | 62/303 |
| 7,624,470 | B2 | * | 12/2009 | Heyman | 15/301 |

FOREIGN PATENT DOCUMENTS

| | | |
|---|---|---|
| DE | 37 38 031 | 5/1989 |
| DE | 100 02 742 | 6/2001 |
| DE | 101 16 238 | 1/2003 |
| EP | 0 468 573 | 1/1992 |
| GB | 2 087 029 | 5/1982 |

OTHER PUBLICATIONS

International Search Report PCT/EP2007/050162.

* cited by examiner

*Primary Examiner* — David Redding
(74) *Attorney, Agent, or Firm* — James E. Howard; Andre Pallapies

(57) ABSTRACT

A cleaning apparatus for a component operatively disposed within a process air-circuit of a household tumble dryer, in particular a heat exchanger of a household tumble dryer, the cleaning apparatus including a cleaning brush configured for operational movement along the component and a drive mechanism having a cleaning brush drive rod operatively connected to the cleaning brush for moving the cleaning brush along the component. The cleaning apparatus further includes a cleaning fluid feed line and means operatively associated with the cleaning fluid feed line for supplying cleaning fluid to the cleaning brush.

21 Claims, 1 Drawing Sheet

CLEANING APPARATUS FOR A COMPONENT OF A HOUSEHOLD TUMBLE DRYER

BACKGROUND OF THE INVENTION

The invention relates to a cleaning apparatus for a component arranged within a process air circuit of a household tumble dryer.

Such a cleaning apparatus is known from EP 0 468 573 A1. In this cleaning apparatus, a heat exchanger in the form of a material evaporator, arranged within a process air-circuit of a household tumble dryer, is to be freed from deposited lint by means of a cleaning brush. To this end, the cleaning brush, which is embodied as a flat brush, moves along a face of the material evaporator, in order to remove the lint or dirt of a similar kind from slats of the material evaporator at least in the area of a depth of penetration which is determined by the length of the bristles of the cleaning brush.

However this known cleaning apparatus is considered disadvantageous in that the lint settling on the material evaporator with condensate from the humid process air can be loosened from the individual slats of the material evaporator only with extreme difficulty, and is then also similarly difficult to remove from the bristles of the cleaning brush. This gives rise to a high risk that over its lifetime the cleaning brush becomes clogged with lint, and the full cleaning performance can accordingly no longer develop, which can have a negative effect on the cooling performance of the material evaporator.

BRIEF SUMMARY OF THE INVENTION

The object of the present invention is thus to create a cleaning apparatus of the type mentioned in the introduction, with which both the component arranged within process air circuit as well as the cleaning brush itself can more simply be freed from lint or dirt of this kind.

According to the invention this object is achieved by means of a cleaning apparatus with the features of the exemplary embodiments described herein.

In the cleaning apparatus according to the invention, provision is made for the cleaning brush to be supplied with a cleaning fluid by means of a feed line. This hereby ensures on the one hand that lint or dirt particles of this kind deposited on the component, for example on the slats of a material evaporator, can be dislodged from the surface of the component with sufficient quantities of cleaning fluid. Overall a cleaning apparatus thereby results in the reliable removal of the adhering lint deposit being ensured, in particular independently of the quantity of the condensate forming on the surface of a material evaporator or a condensation device. Here the quantity of cleaning fluid can be simply controlled by means of appropriate dosing within the feed line. It is also possible to add a cleaning medium, which is capable of simply dissolving the adhering lint deposit, to the cleaning fluid, so that particularly reliable cleaning of the component arranged within the process air-circuit can be achieved. Finally, the feeding of cleaning fluid has the further advantage that the lint or similar dirt collecting on the cleaning brush can better be removed from its bristles, flaps or the like. If accordingly a sufficient quantity of cleaning fluid is present, the lint is thus flushed from the cleaning brush in a simple manner. Clogging of the bristles, flaps or the like of the cleaning brush can hereby be prevented in a reliable and simple manner.

In a further embodiment of the invention it has proven advantageous to connect the drive rod of the cleaning brush, which already exists, with the feed line, with the transport of the cleaning fluid in the area of the cleaning brush then being undertaken by the drive rod.

It has further proven advantageous if the cleaning brush is embodied as a rotationally driven circular brush, where a rotational coupling, which enables the rotation of the cleaning brush, is provided between the feed line and the drive rod. Not only does a circular brush of this kind offer the advantage of very thorough removal of the lint deposit from the surface of the heat exchanger or similar component, but as a result of the centrifugal force produced from the rotation of the circular brush, the lint or similar dirt collecting within the cleaning brush can be particularly effectively dislodged from its bristles, flaps or the like.

In a further embodiment of the invention, the cleaning brush is embodied as a hollow body, in the exterior wall of which is arranged a multiplicity of through-openings for the cleaning fluid. The cleaning fluid can hereby be simply conveyed, over a wide area, to a large proportion of the bristles, flaps or similar of the cleaning brush.

The supply of cleaning fluid to the bundle of bristles can take place via through-openings which emerge between the individual bundles of bristles on the external surface of the hollow body, as well as via receiving holes of the bundles of bristles, which extend as through-openings as far as the inner cavity of the cleaning brush. In one instance the bundles of bristles are supplied via through-openings arranged therebetween. In the other instance, the bundles of bristles are supplied with cleaning fluid directly via receiving holes arranged at their roots.

If the cleaning apparatus also includes a pump, via which the cleaning fluid is to be delivered, then in addition to the centrifugal force caused by the rotational movement of the cleaning brush this is also conveyed in the direction of the bundles of bristles, flaps or the like by the pump pressure.

Finally, the cleaning apparatus can be operated in a particularly cost-effective, manner if water, and in particular the condensate accumulating in the area of the material evaporator or a condensation device for example, is used as the cleaning fluid. In a further embodiment of the invention a cleaning medium can also be added to this water or condensate.

BRIEF DESCRIPTION OF THE DRAWINGS

Further advantages, features and details of the invention may be taken from the following description of a preferred exemplary embodiment, as well from the drawing, in which.

DETAILED DESCRIPTION OF THE PRESENT INVENTION

Figure 1:
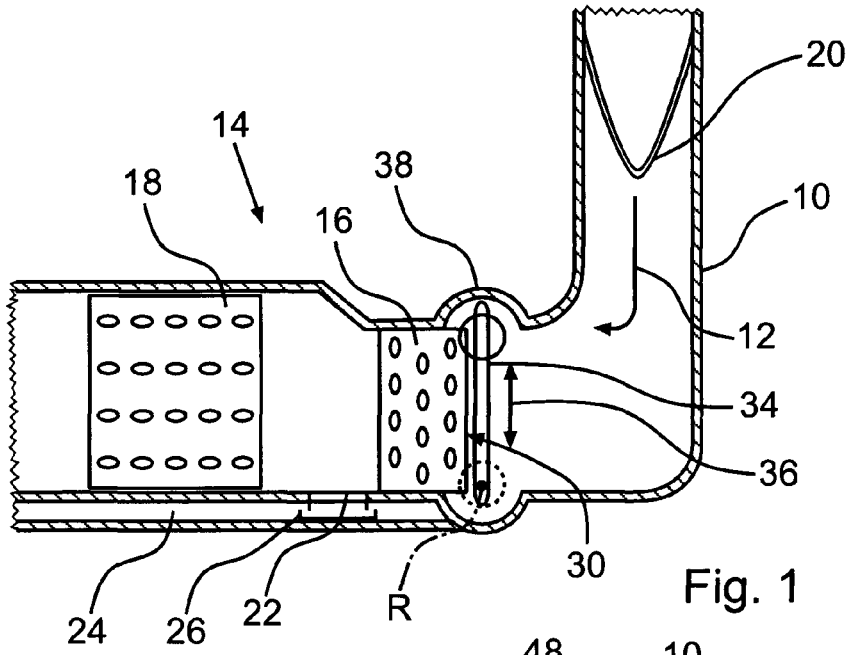
FIG. 1 shows a schematic side-view of a partially visible channel of a process air-circuit of a household tumble dryer, within which is provided a heat exchanger arrangement with a material evaporator, which is to be freed of lint or dirt of a similar kind by a cleaning brush of a cleaning apparatus arranged upstream in the direction of flow of the process air.

FIG. 1 shows a schematic side view of a partially visible channel 10 of a process air circuit of a household tumble dryer, where the process air flows through the channel 10 in a direction indicated by the arrow 12. In FIG. 1, the channel 10 is represented lengthways in cutaway form, so that a heat exchanger arrangement 14 provided in the channel 10 can be seen, which essentially comprises a material evaporator 16 and a material condenser 18. A lint filter 20 is arranged and in the direction of flow within the channel 10 upstream of the heat exchanger arrangement 14, with which lint filter 20 a predominant proportion of lint or dirt particles of a similar kind which are carried along with the stream of humid process air emanating from a laundry drum (not shown) of the household tumble dryer can be separated out. The humid process air passes through the material evaporator 16 downstream of the lint filter 20, where it is cooled accordingly and, as a result of the condensing process, dried. The condensate accumulating in the area of the material evaporator 16 is collected, and leaves the process air circuit via an outlet aperture 22 and an outlet line 24. The condensate can, for example, be conveyed away accordingly via a pump. A catch tray 26 is provided below the outlet aperture 22, in which catch tray lint or dirt particles of a similar kind which have penetrated the lint filter 20 are collected. The catch tray 26, which is preferably arranged in the area of the base of the household tumble dryer, is to be here cleaned by an operator on an occasional basis. Dry process air which has been cooled down by means of the material evaporator 16 is subsequently reheated via the material condenser 18, and fed back into the laundry drum via a fan (not shown).

Figure 2:
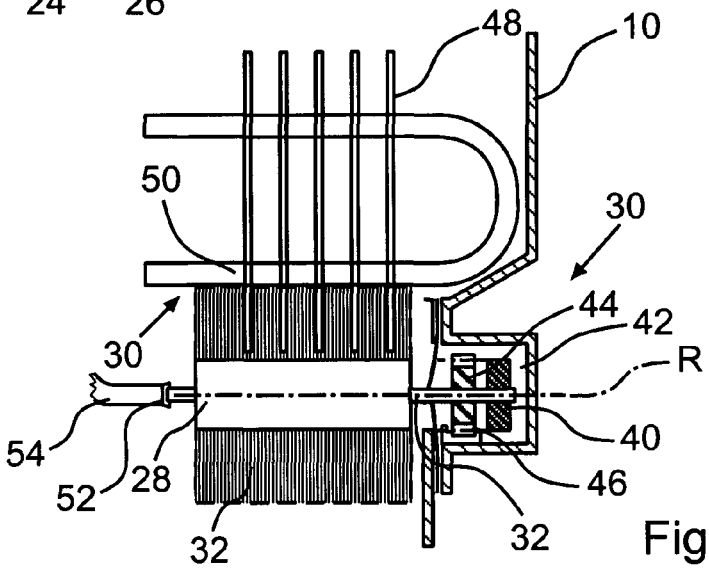
FIG. 2 shows a schematic sectional view of the cleaning brush of the cleaning apparatus, which is to be driven rotationally or in a translatory manner along a frontal face of a material evaporator via a drive mechanism.

In order to clean the material evaporator 16 of lint or dirt particles of a similar kind which have penetrated the lint filter 20, and which, on the basis of empirical evidence, accumulate in particular in the area of the front side facing the lint filter 20, together with the condensate which, a cleaning apparatus with a cleaning brush 28 is provided, which is to be moved along the material evaporator 16 in a translatory and in this instance vertical movement. Seen in conjunction with FIG. 2, which shows a partial sectional view of the cleaning brush 28 dipping into the material evaporator 16 in the area of a frontal face 30, the basic design of the cleaning apparatus can be recognized. The cleaning brush 28 is rotationally driven about a rotational axis R by means of a drive rod 32. In addition, the cleaning brush 28 is to be held at both ends along a vertically running guide 34 and, as represented by arrow 36, moved in a translatory movement along the frontal face 30 of the material evaporator 16. So that almost the entire face 30 of the material evaporator 16 can be freed of lint, bulges 38 are embodied within the channel 10, into which the cleaning brush 28 can penetrate in an upper and lower end position.

For the rotational driving of the cleaning brush 28, a motor 40 with a transmission is arranged within a receiving space 42 of the channel 10, via which as well as the cleaning brush 28, a toothed wheel 44 can be driven, which engages with a gear rack 46. As a result of the pairing of the toothed wheel 44 and gear rack 46, the cleaning brush 28 is to move along the guides 34 or along the frontal face 30 of the material evaporator 16 in a translatory movement. It is also apparent from FIG. 2 that the cleaning brush 28 is able to penetrate from the face 30 into slats 48 of the material evaporator 16 at least sufficiently far for the coolant pipes 50 too to be freed from lint or dirt of a similar kind.

Figure 3:
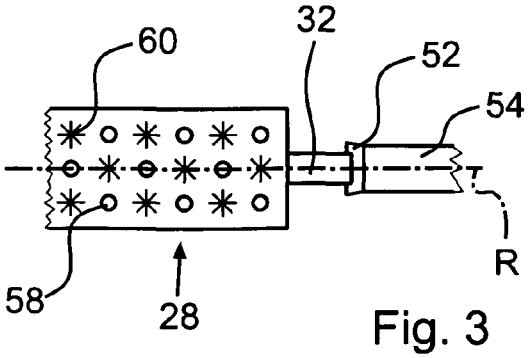
FIG. 3 shows a schematic plan view of a cleaning brush embodied as a circular brush, the drive rod of which is connected with a feed line for cleaning fluid via a rotational coupling.
Figure 4:
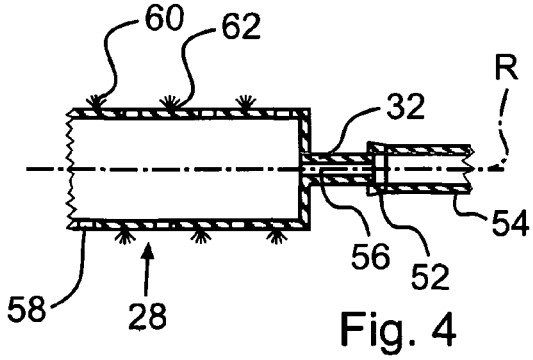
FIG. 4 shows a schematic cross-sectional view along the central longitudinal plane of the cleaning brush with the drive rod and the feed line, where the cleaning brush is embodied as a hollow body, in the external wall of which is arranged a multiplicity of through-openings for the cleaning fluid.

In conjunction with FIGS. 3 and 4, which show the cleaning brush 28 in a schematic plan view or a schematic sectional view along a central longitudinal plane, it is apparent that its drive rod 32 is connected with a feed line 54 for cleaning fluid via a rotational coupling 52. The feed line 54 is arranged here on the side of the cleaning brush 28 which is opposite the motor 40 for example. From FIG. 4 it can additionally be seen that the cleaning brush 28 is embodied as a hollow body in the form of a hollow cylinder, for example made of plastic, which is likewise closed at both the frontal and rear face. Only in the area of the drive rod 32 is embodied a supply aperture 56 running centrally from this, via which the cleaning fluid can flow out of the feed line 54 into the cleaning brush 28. To transport the cleaning fluid into the cleaning brush 28, a pump (not shown) is provided. In the present exemplary embodiment, the cleaning fluid flowing into the cleaning brush 28 can exit via a multiplicity of through-openings 58, which are arranged in the peripheral external wall of the cleaning brush 28. From FIG. 3 in particular it can be seen that the through-openings 58 are arranged alternately with bundles of bristles 60 in rows which run in parallel to the rotational axis R of the cleaning brush 28. Adjacent axial rows of alternating through-openings 58 and bundles of bristles 60 are here arranged relative to each other in such a way as to create radial rows of alternating nozzle apertures 58 and bundles of bristles 60. In other words the through-openings 58 and the bundles of bristles 60 are arranged relative to each other such that both in the axial and in the radial direction, rows are produced which in each case have, alternately, one through-opening 58 and one bundle of bristles 60. This ensures that the bundle of bristles 60 receive an exceptionally even supply of cleaning fluid, which exits via the through-openings 58. Equally, it would also be conceivable to embody the receiving holes 62, into which in each case a bundle of bristles 60 is inserted, as through-openings 58 for the cleaning fluid. In this case, the bundle of bristles 60 would be supplied with cleaning fluid directly from its roots.

In the present exemplary embodiment, water is used as the cleaning fluid; equally, however, it would also be conceivable to employ the condensate accumulated in the area of the outlet line 24 (FIG. 1) to moisten the cleaning brush 28. The water can additionally have a cleaning medium added to it, which facilitates easy dislodging of the lint from the slats 48 of the material evaporator 16. It is evident that as a result of the cleaning fluid, the lint which has become lodged in the cleaning brush 28 can very readily be flushed away. This flushing process is promoted by the rotational movement of the cleaning brush 28 which is embodied as a circular brush.

The invention claimed is:

1. A cleaning apparatus for a component operatively disposed within a process air-circuit of a household tumble dryer, wherein the component is a heat exchanger of the household tumble dryer, the cleaning apparatus including:

a cleaning brush configured for operational movement along the component;

a drive mechanism having a cleaning brush drive rod operatively connected to the cleaning brush for moving the cleaning brush along the component;

a cleaning fluid feed line;

means operatively associated with the cleaning fluid feed line for supplying cleaning fluid to the cleaning brush; and a rotational coupling operationally disposed between the cleaning fluid feed line and the drive rod for rotationally driving the cleaning brush about a rotational axis.

2. The cleaning apparatus according to claim 1 wherein the cleaning fluid feed line is connected to the drive rod.

3. A cleaning apparatus for a component operatively disposed within a process air-circuit of a household tumble dryer, in particular a heat exchanger of a household tumble dryer, the cleaning apparatus including:

a cleaning brush configured for operational movement along the component;

a drive mechanism having a cleaning brush drive rod operatively connected to the cleaning brush for moving the cleaning brush along the component;

a cleaning fluid feed line; and means operatively associated with the cleaning fluid feed line for supplying cleaning fluid to the cleaning brush, wherein the cleaning brush is formed with a generally circular cross section and the cleaning apparatus further comprises a rotational coupling operationally disposed between the cleaning fluid feed line and the drive rod for rotationally driving the cleaning brush about a rotational axis.

4. A cleaning apparatus for a component operatively disposed within a process air-circuit of a household tumble dryer, in particular a heat exchanger of a household tumble dryer, the cleaning apparatus including:

a cleaning brush configured for operational movement along the component;

a drive mechanism having a cleaning brush drive rod operatively connected to the cleaning brush for moving the cleaning brush along the component;

a cleaning fluid feed line; and means operatively associated with the cleaning fluid feed line for supplying cleaning fluid to the cleaning brush, wherein the cleaning brush is formed with an external wall portion defining a hollow body having a plurality of through-openings formed therein for passage of cleaning fluid therethrough.

5. A cleaning apparatus for a component operatively disposed within a process air-circuit of a household tumble dryer, in particular a heat exchanger of a household tumble dryer, the cleaning apparatus including:

a cleaning brush configured for operational movement along the component;

a drive mechanism having a cleaning brush drive rod operatively connected to the cleaning brush for moving the cleaning brush along the component;

a cleaning fluid feed line; and means operatively associated with the cleaning fluid feed line for supplying cleaning fluid to the cleaning brush, wherein the cleaning brush includes receiving holes for a bundle of bristles or similar cleaning elements forming through-openings for the cleaning fluid.

6. The cleaning apparatus according to claim 4 wherein the through-openings are arranged in axial rows extending parallel to an axis of rotation of the cleaning brush.

7. The cleaning apparatus according to claim 6 wherein the hollow body is formed with axial rows including alternating through-openings and bundles of cleaning elements.

8. The cleaning apparatus according to claim 7 wherein adjacent axial rows of alternating through-openings and cleaning elements are arranged relative to each other in a manner forming radially extending rows of alternating through-openings and bundles of cleaning elements.

9. The cleaning apparatus according to claim 1 and further comprising a pump in fluid communication with the cleaning fluid feed line and a cleaning fluid source for supplying cleaning fluid to the cleaning brush through the cleaning fluid feed line.

10. The cleaning apparatus according to claim 1 and further comprising means for using condensate from the process air as cleaning fluid.

11. The cleaning apparatus according to claim 1, wherein the cleaning brush has a substantially circular cross section, the cleaning apparatus further comprising a rotational coupling operationally disposed between the cleaning fluid feed line and the drive rod for rotationally driving the cleaning brush about a rotational axis, wherein the cleaning brush is formed with an external wall portion defining a hollow body having a plurality of through-openings formed therein for passage of cleaning fluid therethrough, and wherein the cleaning brush includes receiving holes for a bundle of bristles or similar cleaning elements forming additional through-openings for the cleaning fluid.

12. A household tumble dryer comprising:

a process air-circuit;

a heat exchanger operatively disposed within the process air-circuit;

a cleaning apparatus that cleans the heat exchanger, the cleaning apparatus including:

a cleaning brush that moves along the heat exchanger;

a drive mechanism having a drive rod operatively connected to the cleaning brush, the drive rod moving the cleaning brush along the heat exchanger;

a cleaning fluid feed line;

means operatively associated with the cleaning fluid feed line for supplying cleaning fluid to the cleaning brush; and a rotational coupling operationally disposed between the cleaning fluid feed line and the drive rod for rotationally driving the cleaning brush about a rotational axis.

13. The household tumble dryer of claim 12, wherein the cleaning fluid feed line is connected to the drive rod.

14. The household tumble dryer of claim 12, wherein the cleaning brush has a substantially circular cross section.

15. The household tumble dryer of claim 12, wherein the cleaning brush includes an external wall portion defining a hollow body having a plurality of through-openings formed therein for passage of cleaning fluid therethrough.

16. The household tumble dryer of claim 12, wherein the cleaning brush includes receiving holes for a bundle of bristles or similar cleaning elements, the receiving holes forming through-openings for the cleaning fluid.

17. The household tumble dryer of claim 14, wherein the through-openings are arranged in axial rows extending parallel to a rotational axis of the cleaning brush.

18. The household tumble dryer of claim 17, wherein the hollow body is formed with axial rows including alternating through-openings and bundles of cleaning elements.

19. The household tumble dryer of claim 18, wherein adjacent axial rows of alternating through-openings and cleaning elements are arranged relative to each other in a manner forming radially extending rows of alternating through-openings and bundles of cleaning elements.

20. The household tumble dryer of claim 12, further comprising a pump in fluid communication with the cleaning fluid feed line and a cleaning fluid source for supplying cleaning fluid to the cleaning brush through the cleaning fluid feed line.

21. The household tumble dryer of claim 12, further comprising means for using condensate from the process air as cleaning fluid.

* * * * *